US011047227B1

(12) United States Patent
Warlick

(10) Patent No.: US 11,047,227 B1
(45) Date of Patent: Jun. 29, 2021

(54) TESTABLE INDEXING PLUG

(71) Applicant: Geoffrey Warlick, Spring, TX (US)

(72) Inventor: Geoffrey Warlick, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/773,020

(22) Filed: Jan. 27, 2020

(51) Int. Cl.

| | |
|---|---|
| ***E21B 23/00*** | (2006.01) |
| ***E21B 47/117*** | (2012.01) |
| ***E21B 34/10*** | (2006.01) |
| ***E21B 37/04*** | (2006.01) |
| *E21B 33/14* | (2006.01) |

(52) U.S. Cl.
CPC ..... *E21B 47/117* (2020.05); *E21B 23/006* (2013.01); *E21B 34/10* (2013.01); *E21B 37/045* (2013.01); *E21B 33/14* (2013.01)

(58) Field of Classification Search
CPC ..... E21B 34/10; E21B 23/004; E21B 23/006
See application file for complete search history.

(56) References Cited

U.S. PATENT DOCUMENTS

2012/0234561 A1* 9/2012 Hall ..... E21B 33/12 166/386
2015/0240593 A1* 8/2015 Stolboushkin ..... E21B 23/006 166/320

* cited by examiner

*Primary Examiner* — Kristyn A Hall
(74) *Attorney, Agent, or Firm* — Cantor Colburn LLP

(57) ABSTRACT

A testable indexing plug includes a body having an outer surface, an inner surface defining a flow path, a first end, a second end, and an intermediate portion extending between the first end and the second end. A valve chamber extends from the first end into the intermediate portion. A valve member is arranged in the valve chamber. The valve member includes a first end portion, a second end portion including an opening, and an intermediate section including one or more ports fluidically connected with the opening. An indexing system shifts the valve member between a first position, wherein the one or more ports are arranged in the valve chamber and a second position, wherein the one or more ports are exposed outside of the valve chamber following a defined number of pressure applications to the valve member.

10 Claims, 7 Drawing Sheets

TESTABLE INDEXING PLUG

BACKGROUND

In the resource recovery industry wellbores may be formed in a resource bearing formation. After forming the, a tubular may be installed to stabilize the wellbore. In some cases, cement is placed between the tubular and the formation. In such cases, cement is introduced into the tubular, flowed downward toward a toe of the wellbore. Upon reaching the toe, the cement begins to flow upwardly between an outer surface of the tubular and an inner surface of the wellbore. After the cementing a communication path is established between the tubular and the formation.

The communication path may be formed by a tubing conveyed perforation (TCP) system that includes a coil tubing rig and explosives. The explosives are conveyed to a targeted depth and activated to perforate the tubular establishing a communication pathway. In other cases, the communication path a shifting sleeve may be installed uphole of a landing collar. The shifting sleeve may shift open one, or have a delay or cycling mechanism that allows operators to perform a pressure test of the wellbore between establishing the communication path.

Prior to performing the pressure test, a wiper plug is run into the wellbore toward the toe. The wiper plug removes residual cement from the inner surface of the tubular and isolate the toe. After the pressure test, the wiper plug is removed in order to re-establish a communication path to the toe. Removing the wiper plug takes time and adds extra trips into the wellbore. Accordingly, the industry would welcome a device that isolates the toe for a pressure test and which could be subsequently reopened without the need for extra coil tubing or other tool trips into the wellbore.

SUMMARY

Disclosed is a testable indexing plug including a body having an outer surface, an inner surface defining a flow path, a first end, a second end, and an intermediate portion extending between the first end and the second end. A valve chamber extends from the first end into the intermediate portion. A valve member is arranged in the valve chamber. The valve member includes a first end portion, a second end portion including an opening, and an intermediate section including one or more ports fluidically connected with the opening. An indexing system shifts the valve member between a first position, wherein the one or more ports are arranged in the valve chamber and a second position, wherein the one or more ports are exposed outside of the valve chamber following a defined number of pressure applications to the valve member.

Also disclosed is a resource exploration and recovery system including a first system and a second system extending into a formation. The second system includes a tubular fluidically connected to the first system. A testable indexing plug is arranged in the tubular. The testable indexing plug includes a body having an outer surface, an inner surface defining a flow path, a first end, a second end, and an intermediate portion extending between the first end and the second end. A valve chamber extends from the first end into the intermediate portion. A valve member is arranged in the valve chamber. The valve member includes a first end portion, a second end portion including an opening, and an intermediate section including one or more ports fluidically connected with the opening. An indexing system shifts the valve member between a first position, wherein the one or more ports are arranged in the valve chamber and a second position, wherein the one or more ports are exposed outside of the valve chamber following a defined number of pressure applications to the valve member.

Further disclosed is a method of selectively fluidically connecting a first system with a toe of a wellbore through a testable indexing plug includes applying a test pressure to a valve member of the testable indexing plug, shifting the valve member in a valve body of the testable indexing plug from a first position to a second position with the test pressure, releasing the test pressure allowing the valve member to shift back to the first position completing a first cycle, completing a selected number of cycles, applying a final test pressure, shifting the valve member in a valve body of the testable indexing plug from the first position to the second position with the final test pressure, and releasing the test pressure allowing the valve member to shift from the second position to a third position fluidically exposing the first system with the toe of the wellbore through the testable indexing plug.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
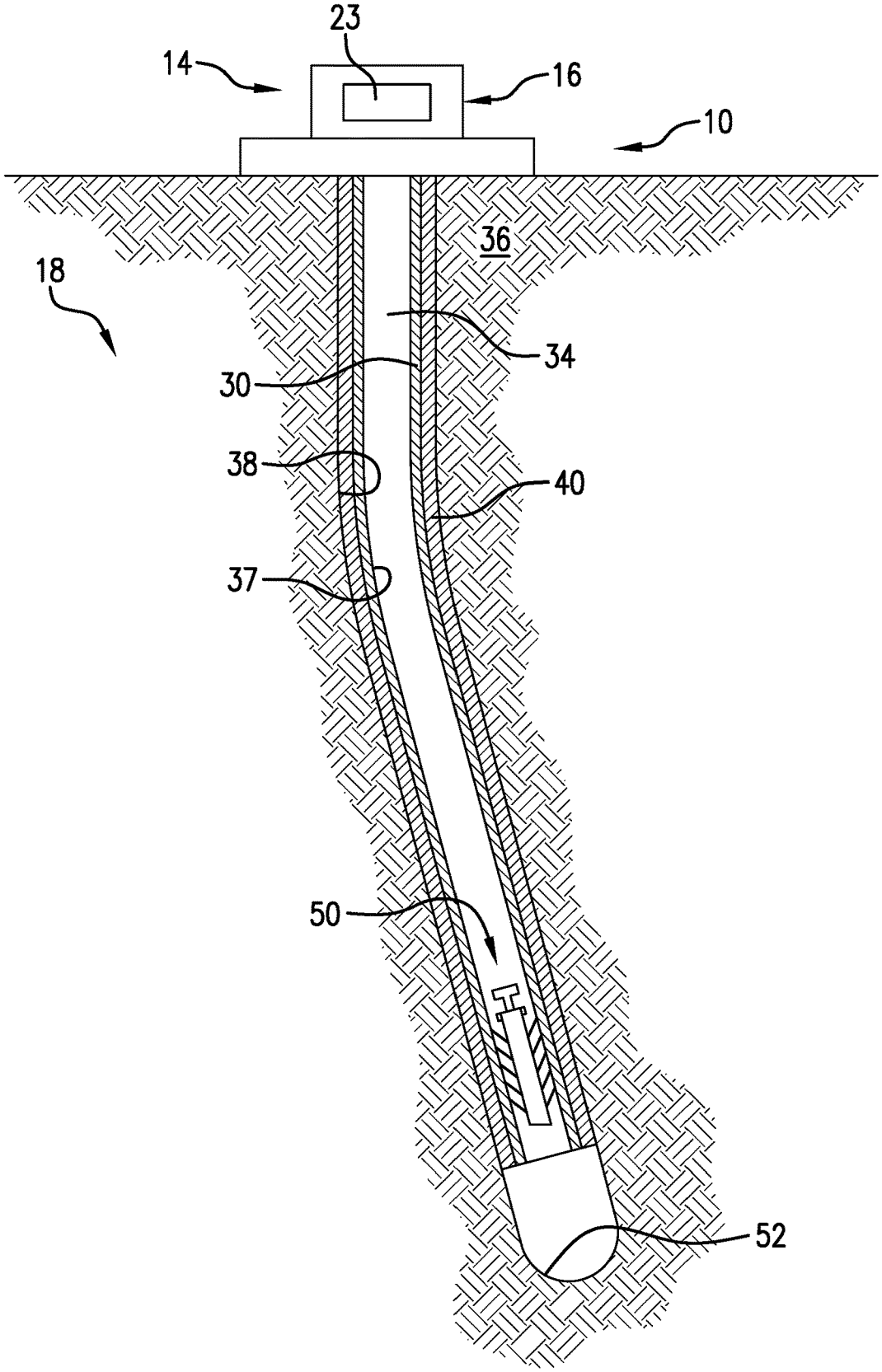
FIG. 1 depicts a resource exploration and recovery system including a testable indexing plug having an indexing system, in accordance with an exemplary embodiment.
Figure 2:
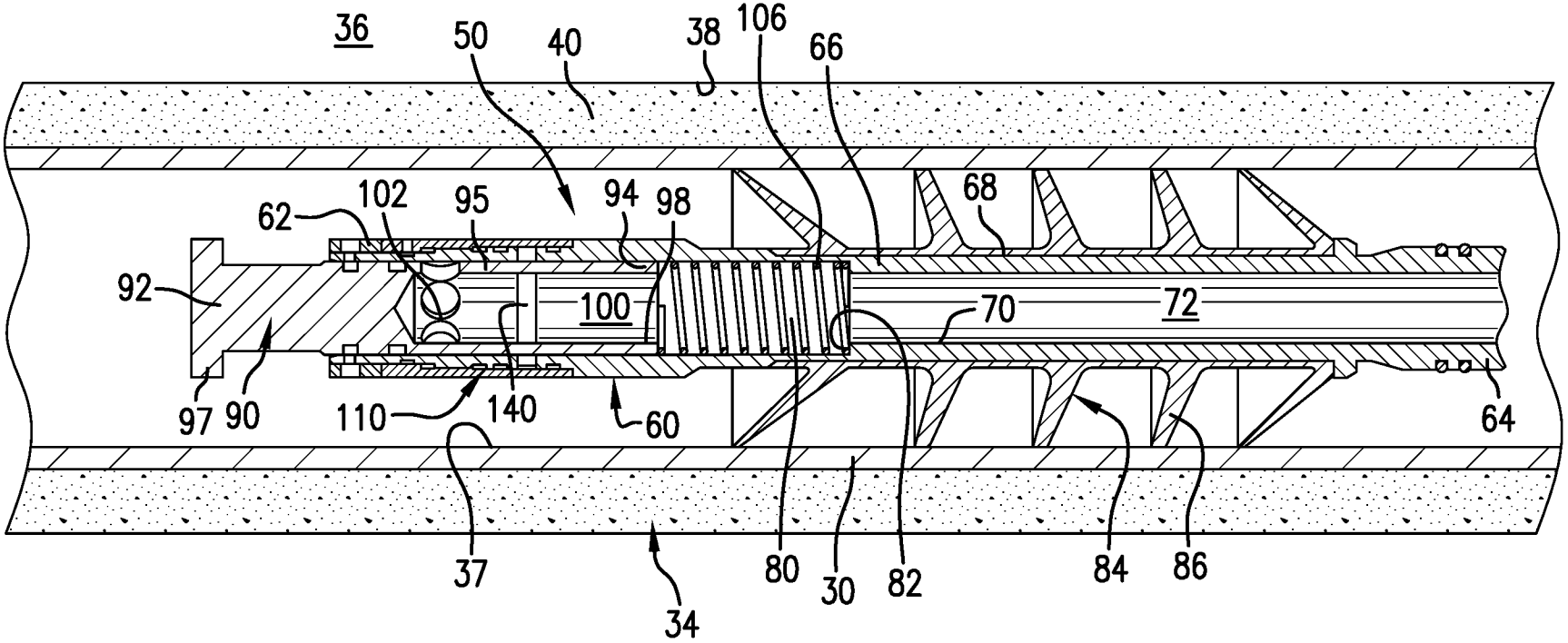
FIG. 2 depicts the testable indexing plug of FIG. 1 illustrating a valve member in a first position, in accordance with an exemplary embodiment.

A resource exploration and recovery system, in accordance with an exemplary embodiment, is indicated generally at 10, in FIGS. 1 and 2. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a casing tubular 30 that extends into a wellbore 34 formed in a formation 36. Casing tubular 30 includes an inner surface 37 and an outer surface (not separately labeled). Wellbore 34 includes an annular wall 38 which may be spaced from the outer surface of casing tubular 30. An amount of cement 40 is provided between annular wall 38 and the outer surface of casing tubular 30. Cement 40 and casing tubular 30 support wellbore 34.

In accordance with an exemplary embodiment, a testable indexing plug 50 is landed in casing tubular 30 at a select depth. Testable indexing plug 50 fluidically isolates first system 16 from a toe 52 of wellbore 34. As shown in FIG. 2, testable indexing plug 50 includes a body 60 having a first end 62, a second end 64, and an intermediate portion 66 extending between the first end 62 and second end 64. Body 60 also includes an outer surface 68 and an inner surface 70 that defines a flow path 72. A valve chamber 80 is defined at first end 62. Valve chamber 80 includes an increased diameter portion (not separately labeled) that extends from first end 62 partially along intermediate portion 66 to a base section 82. Testable indexing plug 50 includes a seal 84 mounted to outer surface 68. Seal 84 includes a plurality of wiper members, one of which is indicated at 86. Wiper members 86 seal against inner surface 37 of casing tubular 30.

Figure 3:
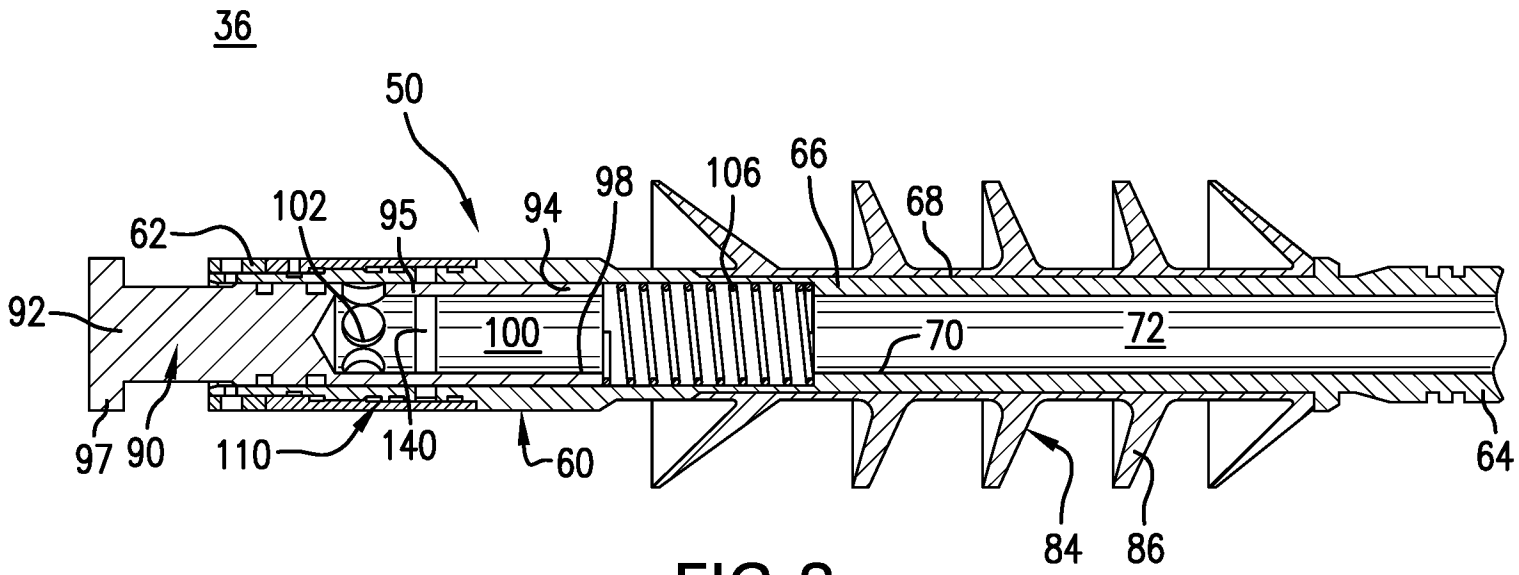
FIG. 3 depicts the testable indexing plug of FIG. 2 illustrating the valve member in a second position, in accordance with an exemplary embodiment.
Figure 4:
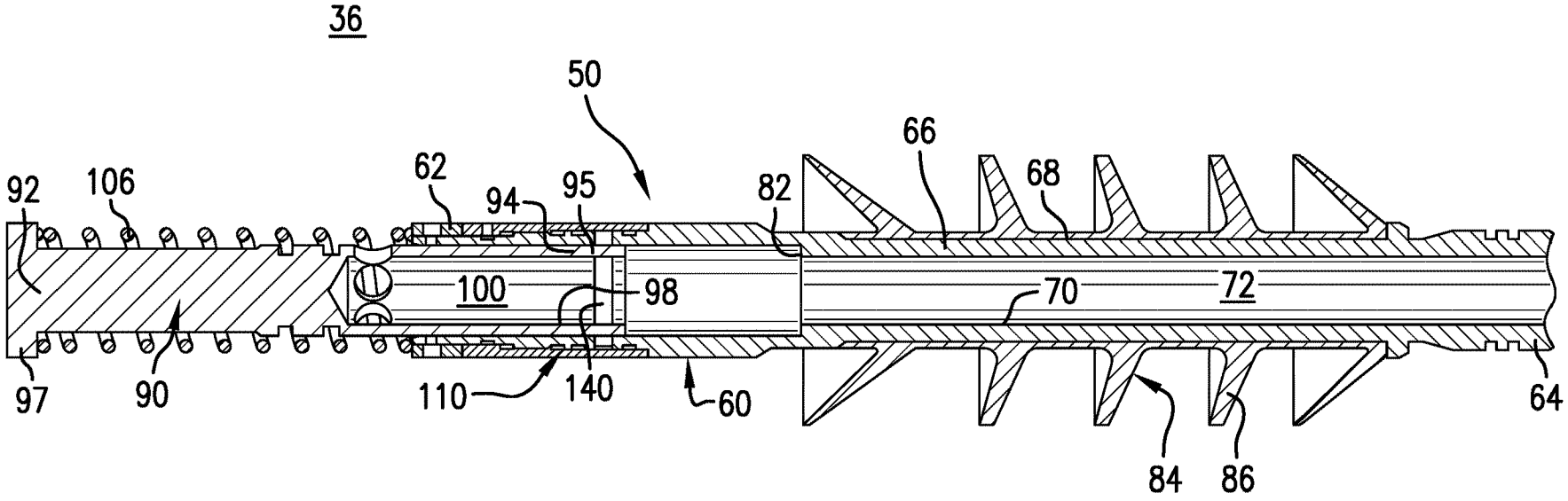
FIG. 4 depicts the testable indexing plug of FIG. 2 illustrating the valve member in a third position, in accordance with an exemplary embodiment.

In further accordance with an exemplary embodiment, testable indexing plug 50 includes a valve member 90 arranged in valve chamber 80. Valve member 90 is selectively shiftable (through the application and removal of fluid pressure) between a first position as shown in FIG. 2, a second position as shown in FIG. 3, and a third position as shown in FIG. 4. Valve member 90 includes a first end portion 92, a second end portion 94, and an intermediate section 95 extending between first end portion 92 and second end portion 94.

A cap element 97 is provided at first end portion 92. Cap element 97 may define a radially outwardly extending projection (not separately labeled). Second end portion 94 includes an opening 98 that exposes a passage 100 extending through intermediate portion 95. Valve member 90 includes a plurality of ports, one of which is indicated at 102, that project radially outwardly from intermediate portion 95 and fluidically connect with passage 100. A return spring 106 is arranged in valve chamber 80. Return spring 106 extends between base section 82 and second end 94 of valve member 90. Return spring 106 axially biases valve member 90 away from first end 62 of body 60. As shown for example in FIG. 5, valve member 90 may also include a first recess 107 that receives one or more shear screws 108 and a second recess 109 that receives an O-ring (not separately labeled).

In accordance with an exemplary embodiment, valve member 90 may selectively fluidically connect first system 14 and toe 52 of wellbore 34. That is, through a predetermined number of pressure cycles, valve member 90 may transition between the first and second positions and, at a selected cycle move to the third position. In an embodiment, the first or neutral position represents a pressure off configuration. An application of fluid pressure in casing tubular 30 forces valve member 90 to shift axially in a first direction toward second end 64 of body 60. Travel of valve member 90 is constrained by a travel stop such as base section 82 in valve chamber 80. Letting off fluid pressure in casing tubular 30 allows valve member 90 to transition back to the first position.

Figure 5:
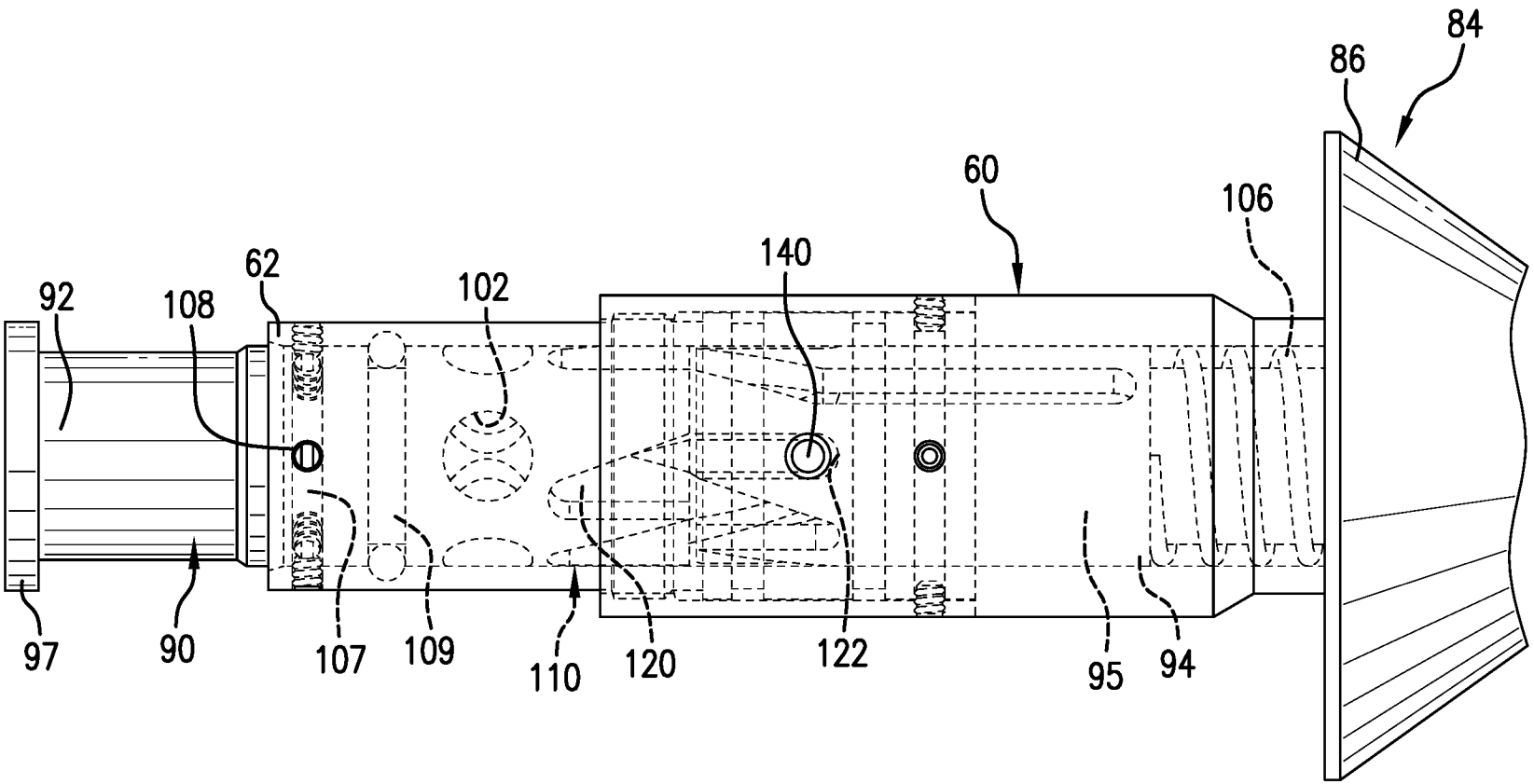
FIG. 5 depicts a partial glass drawing of the testable indexing plug showing the indexing system in a start position.
Figure 6:
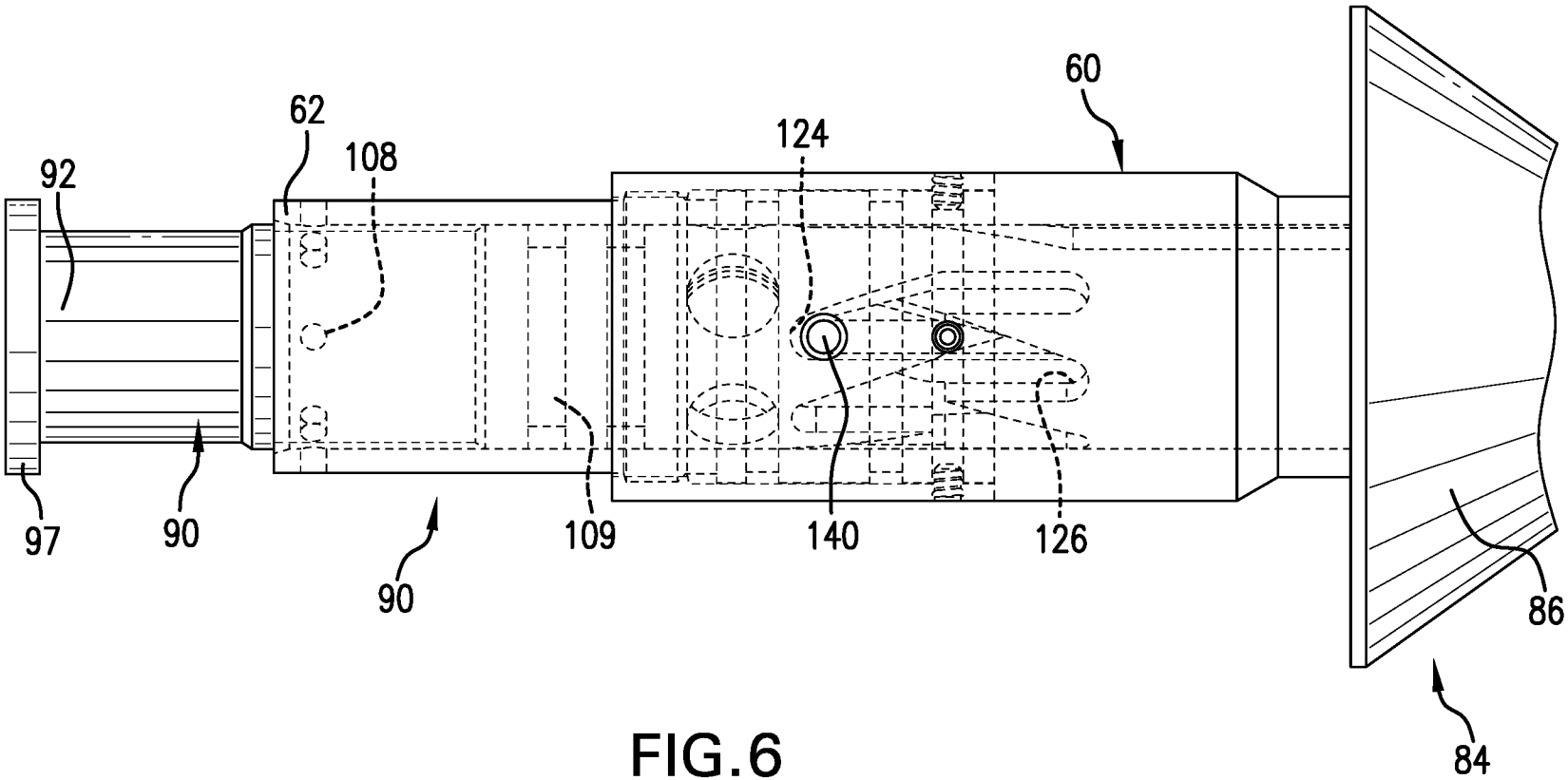
FIG. 6 depicts a partial glass drawing of the testable indexing of FIG. 5 showing the indexing system in an intermediate position.
Figure 7:
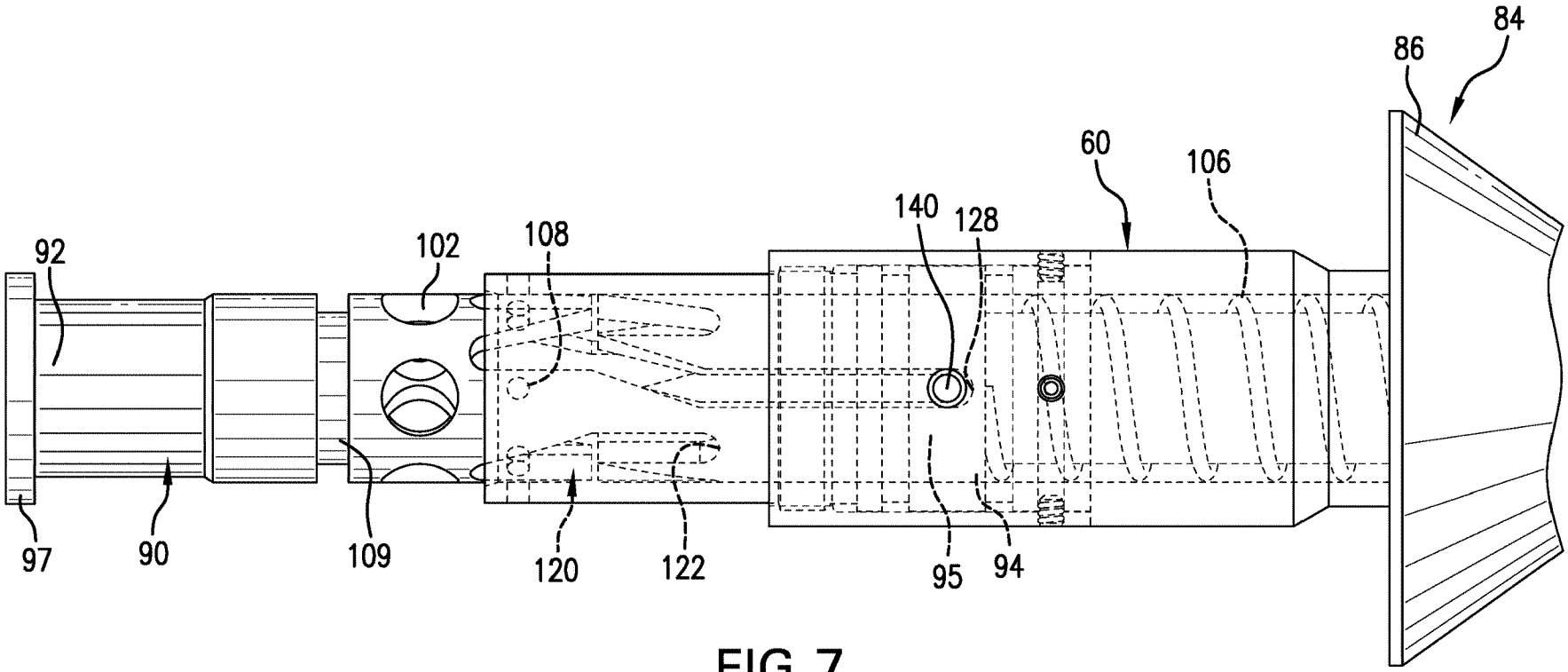
FIG. 7 depicts a partial glass drawing of the testable indexing plug of FIG. 6 Showing the indexing system in an end position in which a flow path is opened.

In an embodiment, testable indexing plug 50 includes an indexing system 110 that may be configured to allow valve member 90 to transition from the second position to the third position at a selected pressure off cycle. As best shown in FIGS. 5-7, indexing system 110 includes a guide track 120 having a start position 122 (FIG. 5), a plurality of intermediate positions, two of which is shown at 124 and 126 in FIG. 6, and an end position 128 such as shown in FIG. 7. Guide track 120 received a guide pin 140 that extends across valve chamber 80 through valve member 90.

Each application and removal of pressure in casing tubular 30 a shifting and relaxation of valve member 90 allowing guide pin 140 to traverse from start position, through intermediate positions 124, and 126. Of course, it should be understood that the number of intermediate positions may vary. At a nth cycle, which may be defined by the number of intermediate positions 124 and 126 or the location of start position 122, a removal of pressure allows guide pint 140 to pass into end position 128 thereby allowing return spring 106 to shift valve member 90 from the second position to the third position. At this point, it should be understood that the start position may be set at one of the intermediate positions. With this arrangement, the testable indexing plug may isolates the toe of the wellbore for a pressure test and then be opened without the need for any additional tool runs.

Set forth below are some embodiments of the foregoing disclosure:

Embodiment 1. A testable indexing plug comprising: a body including an outer surface, an inner surface defining a flow path, a first end, a second end, and an intermediate portion extending between the first end and the second end; a valve chamber extending from the first end into the intermediate portion; a valve member arranged in the valve chamber, the valve member including a first end portion, a second end portion including an opening, and an intermediate section including one or more ports fluidically connected with the opening; and an indexing system that shifts the valve member between a first position, wherein the one or more ports are arranged in the valve chamber and a second position, wherein the one or more ports are exposed outside of the valve chamber following a defined number of pressure applications to the valve member.

Embodiment 2. The testable indexing plug according to any prior embodiment, further comprising: a seal including a plurality of wiper members mounted to and extending outwardly of the outer surface.

Embodiment 3. The testable indexing plug according to any prior embodiment, wherein the second end portion of the valve member includes a cam portion and the inner surface of the body includes a stop portion, at least one of the cam portion and the stop portion including a selected number of landing zones that maintain the one or more ports in the flow path and at least one release zone that enables the valve member to shift axially outwardly of the body fluidically connecting the one or more ports and the second end.

Embodiment 4. The testable indexing plug according to any prior embodiment, further comprising: a return spring extending about a portion of the valve member.

Embodiment 5. The testable indexing plug according to any prior embodiment, wherein the first end portion of the valve member includes a radially outwardly projecting lip, the return spring includes a first end arranged at the radially outwardly projecting lip and a second end abutting the first end of the body.

Embodiment 6. A resource exploration and recovery system comprising: a first system; a second system extending into a formation, the second system including a tubular fluidically connected to the first system; and a testable indexing plug arranged in the tubular, the testable indexing plug comprising: a body including an outer surface, an inner surface defining a flow path, a first end, a second end, and an intermediate portion extending between the first end and the second end; a valve chamber extending from the first end into the intermediate portion; a valve member arranged in the valve chamber, the valve member including a first end portion, a second end portion including an opening, and an intermediate portion including one or more ports fluidically connected with the opening; and an indexing system that shifts the valve member between a first position, wherein the one or more ports are arranged in the valve chamber and a second position, wherein the one or more ports are exposed outside of the valve chamber following a defined number of pressure applications to the valve member.

Embodiment 7. The resource exploration and recovery system according to any prior embodiment, further comprising: a plurality of wiper seals mounted to and extending outwardly of the outer surface.

Embodiment 8. The resource exploration and recovery system according to any prior embodiment, wherein the second end portion of the valve member includes a cam portion and the inner surface of the body includes a stop portion, at least one of the cam portion and the stop portion including a selected number of landing zones that maintain the one or more ports in the flow path and at least one release zone that enables the valve member to shift axially outwardly of the body fluidically connecting the one or more ports and the second end.

Embodiment 9. The resource exploration and recovery system according to any prior embodiment, further comprising: a return spring extending about a portion of the valve member.

Embodiment 10. The resource exploration and recovery system according to any prior embodiment, wherein the first end portion of the valve member includes a radially outwardly projecting lip, the return spring includes a first end arranged at the radially outwardly projecting lip and a second end abutting the first end of the body.

Embodiment 11. A method of selectively fluidically connecting a first system with a toe of a wellbore through a testable indexing plug comprising: applying a test pressure to a valve member of the testable indexing plug; shifting the valve member in a valve body of the testable indexing plug from a first position to a second position with the test pressure; releasing the test pressure allowing the valve member to shift back to the first position completing a first cycle; completing a selected number of cycles; applying a final test pressure; shifting the valve member in a valve body of the testable indexing plug from the first position to the second position with the final test pressure; and releasing the test pressure allowing the valve member to shift from the second position to a third position fluidically exposing the first system with the toe of the wellbore through the testable indexing plug.

Embodiment 12. The method according to any prior embodiment, further comprising: introducing the testable indexing plug into the wellbore; and guiding the testable indexing plug to a selected depth, wherein guiding the testable indexing plug includes wiping internal surfaces of the wellbore with a plurality of wipers extending from the testable indexing plug.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A testable indexing plug comprising:

a body including an outer surface, an inner surface defining a flow path, a first end, a second end, and an intermediate portion extending between the first end and the second end;

a valve chamber extending from the first end into the intermediate portion;

a valve member arranged in the valve chamber, the valve member including a first end portion, a second end portion including an opening, and an intermediate section including one or more ports fluidically connected with the opening; and an indexing system that shifts the valve member between a first position, wherein the one or more ports are arranged in the valve chamber and a second position, wherein the one or more ports are exposed outside of the body following a defined number of pressure applications to the valve member.

2. The testable indexing plug according to claim 1, further comprising: a seal including a plurality of wiper members mounted to and extending outwardly of the outer surface.

3. The testable indexing plug according to claim 1, wherein the second end portion of the valve member includes a cam portion and the inner surface of the body includes a stop portion, at least one of the cam portion and the stop portion including a selected number of landing zones that maintain the one or more ports in the flow path and at least one release zone that enables the valve member to shift axially outwardly of the body fluidically connecting the one or more ports and the second end.

4. The testable indexing plug according to claim 1, further comprising: a return spring extending about a portion of the valve member.

5. The testable indexing plug according to claim 4, wherein the first end portion of the valve member includes a radially outwardly projecting lip, the return spring includes a first end arranged at the radially outwardly projecting lip and a second end abutting the first end of the body.

6. A resource exploration and recovery system comprising:

a first system;

a second system extending into a formation, the second system including a tubular fluidically connected to the first system; and a testable indexing plug arranged in the tubular, the testable indexing plug comprising:

a body including an outer surface, an inner surface defining a flow path, a first end, a second end, and an intermediate portion extending between the first end and the second end;

a valve chamber extending from the first end into the intermediate portion;

a valve member arranged in the valve chamber, the valve member including a first end portion, a second end portion including an opening, and an intermediate portion including one or more ports fluidically connected with the opening; and an indexing system that shifts the valve member between a first position, wherein the one or more ports are arranged in the valve chamber and a second position, wherein the one or more ports are exposed outside of the body following a defined number of pressure applications to the valve member.

7. The resource exploration and recovery system according to claim 6, further comprising: a plurality of wiper seals mounted to and extending outwardly of the outer surface.

8. The resource exploration and recovery system according to claim 6, wherein the second end portion of the valve member includes a cam portion and the inner surface of the body includes a stop portion, at least one of the cam portion and the stop portion including a selected number of landing zones that maintain the one or more ports in the flow path and at least one release zone that enables the valve member to shift axially outwardly of the body fluidically connecting the one or more ports and the second end.

9. The resource exploration and recovery system according to claim 6, further comprising: a return spring extending about a portion of the valve member.

10. The resource exploration and recovery system according to claim 9, wherein the first end portion of the valve member includes a radially outwardly projecting lip, the return spring includes a first end arranged at the radially outwardly projecting lip and a second end abutting the first end of the body.

* * * * *